United States Patent [19]

Fujii

[11] 3,963,239

[45] June 15, 1976

[54] BASEBALL BAT

[76] Inventor: Hirokazu Fujii, No. 59, 2-chome, Obiraki-cho, Fukushima, Osaka, Japan

[22] Filed: June 28, 1974

[21] Appl. No.: 484,348

Related U.S. Application Data

[63] Continuation-in-part of Ser. No. 237,390, March 23, 1972, abandoned.

[30] Foreign Application Priority Data

Mar. 23, 1971 Japan.....46-20827
June 6, 1971 Japan.....46-56014

[52] U.S. Cl...... 273/72 A
[51] Int. Cl.[2]..... A63B 59/06
[58] Field of Search..... 273/67 R, 67 D, 67 DA, 273/67 DB, 72 R, 72 A, 73 R, 73 C, 73 H, 80 R, 80 B, 82 R, 82 A, 68

[56] References Cited

UNITED STATES PATENTS

| | | | |
|---|---|---|---|
| 1,499,128 | 6/1924 | Shroyer | 273/72 A |
| 1,611,858 | 12/1926 | Middlekauff | 273/72 A |
| 3,048,400 | 8/1962 | Friedman | 273/82 R |
| 3,116,926 | 1/1964 | Owen et al. | 273/72 R |
| 3,310,903 | 3/1967 | Binvignat | 273/72 A X |
| 3,334,901 | 8/1967 | Steffes | 273/72 A X |
| 3,461,593 | 8/1969 | Martuch et al. | 273/80 B X |

FOREIGN PATENTS OR APPLICATIONS

| | | | |
|---|---|---|---|
| 726,578 | 1/1966 | Canada | 273/68 |
| 23,495 | 9/1949 | Finland | 273/72 R |
| 8,628 | 4/1911 | United Kingdom | 273/67 DB |

*Primary Examiner*—Richard J. Apley
*Attorney, Agent, or Firm*—Stewart and Kolasch, Ltd.

[57] ABSTRACT

A substantially hollow metallic ball bat being adaptable to a change in weight, center of gravity and impact resistance which comprises a generally cylindrical barrel portion and a generally cylindrical handle portion, said barrel portion being larger in diameter than said handle portion, and a hard, rigid, lightweight, high impact resistant cylindrical reinforcing member removably disposed solely inside of said barrel portion, the outer periphery of said reinforcing member being in tight engaging relationship with the inner periphery of the barrel portion of the bat, said reinforcing member, because of its removable feature, being replaceable with a different reinforcing member, thereby making the ball bat adaptable to a change in weight, center of gravity and impact resistance.

5 Claims, 6 Drawing Figures

BASEBALL BAT

BACKGROUND AND SUMMARY OF THE INVENTION

The present application is a continuation-in-part application of application Ser. No. 237,390, filed Mar. 23, 1972, now abandoned.

The present invention relates to an implement for hitting a ball in a baseball or softball game, and more particularly, to a ball bat, for example, a baseball or softball bat comprising a hollow metallic tube having a batting portion for hitting a ball, the inside of said batting portion containing a cylindrically shaped reinforcing member for enhancing the batting effect or increasing the impact resistance when the bat strikes the ball.

In recent years the production of metallic baseball bats has remarkably increased and paralells that of conventional wooden baseball and/or softball bats. Most of these metallic ball bats are manufactured through a mechanical drawing process wherein a metallic tube material having a diameter substantially equal to the largest diameter of a desired ball bat is formed into a bat by gradually reducing the diameter of the tubular material toward one of its ends, that is, toward the grip portion of the bat. However, when the above-mentioned drawing process is applied to the production of metallic ball bats, the peripheral wall of the bat thus produced is not uniform in thickness throughout its entire length. It is inevitable that the grip portion of the bat, that is, the portion with the smallest diameter, has the thickest walls whereas the batting portion or that portion having the largest diameter has the thinnest walls. Thus, the center of gravity of the bat is displaced downward toward the grip portion of the bat with the results that the batting portion of the ball bat is not as effective as desired for hitting a ball.

Inasmuch as most of the existing metallic ball bats are produced by the above-mentioned mechanical drawing method, the particular bat products composed of a lightweight material must be further machined, such as by lathing or the like, whereby the batting portion and the grip portion is formed to have a desired thickness. As a result, the production costs of such products is unavoidably very expensive. On the other hand, when the grip portion of the conventional type metallic bat is made with thin walls by said drawing process, the batting portion of the bat is inevitably made too thin, causing a serious drawback in the resisting force of the batting portion of the bat against the impulse produced when the bat strikes the ball.

Accordingly, the present invention has been designed to eliminate the above-mentioned drawbacks and has as one of its main objects, a novel type of metallic bat containing a batting portion which possesses a high impact resistance when the bat strikes a ball.

Another object of the present invention is to provide a metallic ball bat which can be easily and economically mass produced with a standard configuration but with variable weights by merely inserting into a hollow cavity of the batting portion of said bat a cylindrical reinforcing member having a desired weight.

A further object of the present invention is to provide ball bats having different centers of gravity by merely selectively changing the weight of said cylindrical reinforcing members.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
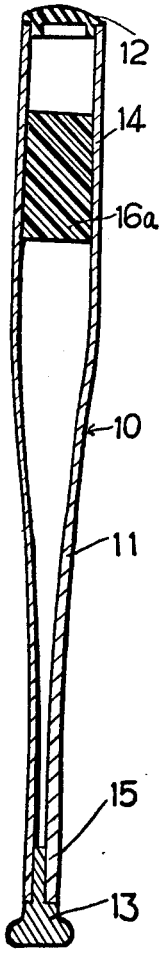
FIG. 1 is a vertical longitudinal section showing a metallic ball bat of the present invention in which a solid cylindrical reinforcing member is disposed inside the cavity of the bat.
Figure 2:
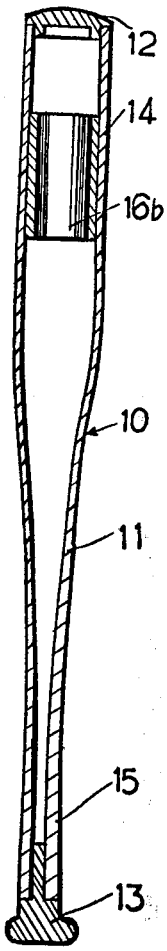
FIG. 2 is a vertical longitudinal section similar to FIG. 1 showing a ball bat in which a hollow cylindrical reinforcing member is disposed in the inside cavity of the bat.
Figure 3:
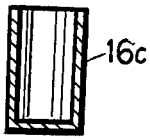
FIG. 3 is a view showing a modification of the cylindrical reinforcing member of FIG. 2 wherein one end of the hollow cylindrical reinforcing member has a bottom wall.
Figure 4:
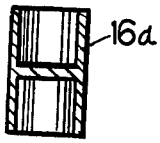
FIG. 4 is a view showing a further modification of the cylindrical reinforcing member of FIG. 2 wherein the hollow cylindrical reinforcing member has an interior partition.

Referring now to the accompanying drawings, the metallic ball bat embodying the present invention is generally designated by element 10 which is provided with a metallic tubular body 11. Preferably, the uppermost head of the metallic tubular body 11 is crowned with a cover 12 made of vulcanized rubber or the like, and the lowermost portion is plugged with an end cap 13 made of rubber, or the like, thereby preventing a batter's hands from slipping off the grip portion of the bat due to the impulse caused by the force of the bat striking against a pitched ball. The metallic tubular body 11 includes a batting portion 14 where a pitched ball is most likely to contact the bat and a grip portion 15 which is firmly grasped by the hands of the batter. The tubular body is diametrically reduced from the batting portion 14 down to the grip portion 15 in a manner approximating the shape of conventional ball bats. The inside of the batting portion 14 is provided with a cavity which is adapted to contain a cylindrical reinforcing member of the type shown in the embodiments of 16a through **16*d*. The cylindrical reinforcing member is composed of a suitable hard material having a high repelling force so that an effective result is produced when a pitched ball is struck by the bat. The cylindrical reinforcing member may be formed into any suitable shape subject to the properties of the material to be employed. For example, in FIG. 1, the cylindrical reinforcing member is a round-bar like member which is composed of a solid, hard, non-cellular lightweight plastic or metallic material. FIG. 2 shows a hollow tubular cylindrical reinforcing member 16***b* made of either a metallic or plastic material. In FIG. 3 the cylindrical reinforcing tubular member 16c has a bottom wall and in FIG. 4 the cylindrical reinforcing member 16d has an internally disposed partition intermediate of the walls of the reinforcing member.

Figure 5:
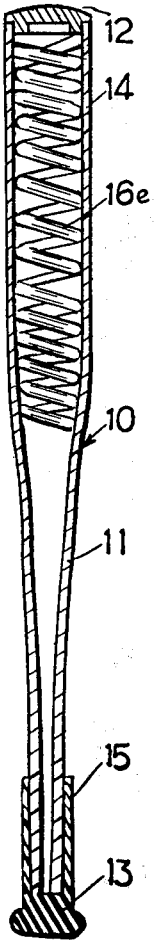
FIG. 5 is a partially sectional view showing a modified baseball bat of the present invention wherein a coil spring is employed in place of any of the above-mentioned cylindrical reinforcing members.
Figure 6:
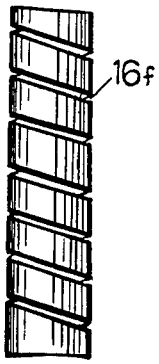
FIG. 6 shows a helical member as a modification of the coil spring of FIG. 5.

Any of the above-mentioned tubular insertion members 16*a* to 16*d*, which may be made of either a metallic or plastic material, may be replaced with a coil spring 16*e* shown in FIG. 5. Furthermore, in place of said coil spring 16*e*, a helical insertion member 16*f* as shown in FIG. 6, may be used to provide the repelling and reinforcing effect similarly as is produced by any of said insertion members 16*a* to 16*d*. Although the insertion member shown in the embodiments of FIGS. 5 and 6 can be made of either plastic or a metallic material, a metallic insertion member is preferred. It will be readily understood that the linear section of the coil spring 16*e* or the helical metallic insertion member 16*f* may be formed in a round or square shape in order to produce the desired repelling and reinforcing effect. When supplying the cavity of the batting portion 14 with any of said insertion members 16*a* to 16*f*, it is necessary to provide said insertion members in tight abutment with the inner periphery of the metallic tubular body 11 so that the desired repelling force of the batting portion 14 can be obtained.

The coil spring reinforcing member 16*e* and the helical metallic insertion member 16*f* offer the additional advantage that when they are forcibly inserted into the cavity of the metallic tubular body 11 which is gradually reduced toward the grip 15 of the bat, said reinforcing members tend to expand against the increasing pressure of the inner periphery of the body 11 due to its change in diameter in its axial direction. This particular feature produces a remarkably high impact-resisting force. In this regard, the more closely convoluted the coil spring 16*e* or the helical metallic member 16*f* are provided, the greater is the repelling force produced thereby.

If any of the reinforcing members 16*a* to 16*f* is inserted into the inner cavity of the metallic tubular body 11 with the use of a suitable adhesive applied to the outer surface of said reinforcing member, the engaging relationship of said reinforcing member with the inner periphery of the body 11 is firmly established and cannot be loosened by the repeated contact of a pitched ball against the batting portion 14 of the bat. Thus, according to the present invention, the center of gravity of the ball bat 10 where the greatest impact resisting force should be maintained can be oriented in the batting portion 14 by forcibly inserting any of the reinforcing members 16*a* to 16*f* into the inner cavity of the metallic cylindrical body 10 thereby increasing the hardness and reinforcing stability of the batting portion so that the impact resisting force of the batting portion of the bat when struck by a pitched ball is remarkably increased and at the same time, the reinforcing effect of the batting portion is also greatly enhanced. Furthermore, the total weight of the bat can be selectively changed by introducing any of the dimensionally and qualitatively different reinforcing members 16*a* to 16*f* into the inner cavity of the metallic tubular body 11 which has been previously produced to a desired standard size. Accordingly, a variety of ball bats 10 having different weights can be offered on the market so that each potential consumer can selectively and economically obtain a bat having a weight most suited to his particular physical condition.

Furthermore, in producing the ball bat 10 of the present invention, the center of its gravity, in which the greatest impact resisting force is potentially producable, can be selectively changed by adjusting the position of the insertion members 16*a* to 16*f* whereby ball bats which have the same weight but a different center of gravity can be produced at a low cost. Also, as a result thereof, during the course of a ballgame, a batter can choose a bat which is most suitable in both weight and center of gravity depending upon the pitcher's particular style of throwing the ball.

The invention being thus described, it will be obvious that the same may be varied in many ways. Such variations are not to be regarded as a departure from the spirt and scope of the invention, and all such modifications are intended to be included within the scope of the following claims.

I claim:

1. A substantially hollow metallic ballbat having a high impact resistance and being adapted to a change in weight, center of gravity and repelling force which comprises a generally cylindrical barrel portion defining a generally cylindrical barrel chamber and a generally cylindrical handle portion defining a generally cylindrical handle chamber, said barrel portion and its associated chamber being larger in diameter than said handle portion and its associated chamber, respectively, said barrel portion being connected to said handle portion by a tapered intermediate portion which contains a tapered intermediate chamber which connects said barrel chamber with said handle chamber, and said barrel portion having an open end, a closure means removably disposed in the open end of said barrel portion and a hard, rigid, lightweight, high impact resistant, coiled, cylindrical reinforcing member removably disposed inside said barrel chamber and extending substantially the entire length of said barrel chamber and into the upper region of said tapered chamber, the outer periphery of said reinforcing member being in tight engaging relationship with the wall of the barrel chamber and the wall of the upper region of said tapered chamber and tending to expand against the increasing pressure of the walls of said barrel chamber and tapered chamber due to the changing diameter of said chambers, said reinforcing member producing a high impact resisting force in said bat.

2. The ball bat of claim 1, wherein the coiled reinforcing member is a coiled spring.

3. The ball bat of claim 1, wherein the coiled reinforcing member is a helical member.

4. The ball bat of claim 1, wherein the handle portion contains an open end which is provided with a closure means.

5. The ball bat of claim 1, wherein the reinforcing member is made of a material selected from the group consisting of a plastic material and a metallic material.

* * * * *